US010378849B1

(12) United States Patent
Mao et al.

(10) Patent No.: US 10,378,849 B1
(45) Date of Patent: Aug. 13, 2019

(54) TESTING DEVICE FOR STUDY OF MAGNETIZED PLASMA ARTILLERY AND GUNPOWDER

(71) Applicant: PEOPLE?S LIBERATION ARMY ARMY ACADEMY OF ARMORED FORCES, Beijing (CN)

(72) Inventors: Baoquan Mao, Beijing (CN); Xianghua Bai, Beijing (CN); Yuying Yang, Beijing (CN); Hua Li, Beijing (CN); Zhenhui Xu, Beijing (CN); Cheng Li, Beijing (CN); Shuai Feng, Beijing (CN); Rui Zhu, Beijing (CN); Zhiqian Wang, Beijing (CN); Tianyi Zhang, Beijing (CN)

(73) Assignee: PEOPLE'S LIBERATION ARMY ARMY ACADEMY OF ARMORED FORCES, Beijing (CN)

( * ) Notice: Subject to any disclaimer, the term of this patent is extended or adjusted under 35 U.S.C. 154(b) by 0 days.

(21) Appl. No.: 16/188,163

(22) Filed: Nov. 12, 2018

(30) Foreign Application Priority Data

Nov. 17, 2017 (CN) ..... 2017 1 1146612.1

(51) Int. Cl.
*F41A 23/16* (2006.01)
*F41A 31/00* (2006.01)
*F41B 6/00* (2006.01)

(52) U.S. Cl.
CPC ..... *F41A 23/16* (2013.01); *F41A 31/00* (2013.01); *F41B 6/006* (2013.01)

(58) Field of Classification Search
CPC ..... F41A 23/16; F41A 31/00; F41A 31/02; F41B 6/006
See application file for complete search history.

(56) References Cited

U.S. PATENT DOCUMENTS 4,467,696 A * 8/1984 McNab ..... F41B 6/006 124/3
5,115,743 A * 5/1992 Loffler ..... F41A 1/04 102/202.7

(Continued)

OTHER PUBLICATIONS

"Products << Bill Wiseman", Bill Wiseman & Co. Inc., https://www.wisemanballistics.com/product/, Jan. 23 (Year: 2017).*

*Primary Examiner* — Joshua T Semick
(74) *Attorney, Agent, or Firm* — SZDC Law P.C.

(57) ABSTRACT

A testing device for study of a magnetized plasma artillery and gunpowder, comprising a pedestal, wherein a top end of the pedestal is provided with a sliding slot for mounting a buffer device, which penetrates through an upper part of the pedestal along a front-rear direction. The sliding slot for mounting the buffer device is internally provided with a buffering slider, which can slide back and forth along the sliding slot for mounting the buffer device. A top end of the buffering slider is provided with a gunpowder combustion chamber fixing groove, which penetrates through an upper part of the buffering slider along the front-rear direction. The gunpowder combustion chamber fixing groove is internally provided with a gunpowder combustion chamber, and an upper part of the gunpowder combustion chamber is provided with a positioning ferrule for fixing the gunpowder combustion chamber.

9 Claims, 4 Drawing Sheets

A front end of the gunpowder combustion chamber 5 is provided with an exhaust port that communicates with an air inlet at a back end of an artillery simulated tube 7.

A side wall of the artillery simulated tube 7 is provided with at least one temperature sensor and at least one magnetic field sensor.

The visible window 10 is provided with a plugging block.

(56) References Cited

U.S. PATENT DOCUMENTS

| | | | | |
|---|---|---|---|---|
| 7,052,736 | B2 * | 5/2006 | Wei | B05D 1/62 427/230 |
| 7,351,480 | B2 * | 4/2008 | Wei | B05D 1/62 428/156 |
| 9,062,949 | B1 * | 6/2015 | Clemen, Jr. | F42B 30/00 |
| 9,562,736 | B2 * | 2/2017 | Grossnickle | F41B 6/003 |
| 9,574,837 | B2 * | 2/2017 | Sullivan | F41A 17/06 |
| 9,617,016 | B2 * | 4/2017 | Palmer | B64G 1/402 |

* cited by examiner

A front end of the gunpowder combustion chamber 5 is provided with an exhaust port that communicates with an air inlet at a back end of an artillery simulated tube 7.

A side wall of the artillery simulated tube 7 is provided with at least one temperature sensor and at least one magnetic field sensor.

The visible window 10 is provided with a plugging block.

The artillery simulated tube 7 is provided with a gas flow rate sensor.

The back end of the artillery simulated tube 7 is fixedly connected to the front end of the gunpowder combustion chamber 5 through a screw thread.

TESTING DEVICE FOR STUDY OF MAGNETIZED PLASMA ARTILLERY AND GUNPOWDER

This application claims priority to Chinese Patent Application No.: 201711146612.1, filed Nov. 17, 2017, which is incorporated by reference for all purposes as if fully set forth herein.

FIELD OF THE INVENTION

The present disclosure relates to a testing device for study of a magnetized plasma artillery and gunpowder.

BACKGROUND OF THE INVENTION

An invention patent application publication (Application No. CN 201510137072.5, published as CN 104697397B on Jun. 15, 2016, titled "MAGNETIZED PLASMA ARTILLERY") discloses a magnetized plasma artillery. A tube of the artillery is provided with a magnetic field, wherein a direction of the magnetic field directs to a muzzle along an axial direction of the tube, and an intensity of the magnetic field is in an attenuated distribution from an inner wall of the tube to an axial line of the tube. When the artillery fires, under the action of the magnetic field, gas in the tube can be ionized into plasmas, and a plasma sheath is formed on the inner wall of the tube.

The magnetized plasma sheath formed on the inner wall of the tube of the magnetized plasma artillery exhibits pressure anisotropy and has a thermal insulation effect, which can greatly reduce the radial force on the tube of the artillery, greatly increase the projectile impetus, greatly improve the heat resistance of the tube, and prolong the service life.

The above magnetized plasma artillery forms the plasma sheath under the action of the magnetic field by means of charged particles generated in high-temperature gas produced by explosion of propellant powder. Therefore, if the concentration of the charged particles in the high-temperature gas produced by explosion of the propellant powder can be further increased, the capability of protection of the magnetized plasma sheath of the magnetized plasma artillery to the tube of the artillery can be further greatly improved, the heat resistance of the tube can be greatly improved, and the service life of the tube can be prolonged. Therefore, it is particularly necessary to further make an in-depth analysis of effects of gas temperature on plasma thermal insulation characteristics, effects of plasma density on the plasma thermal insulation characteristics, and effects of magnetic field intensity and magnetic field direction on the plasma thermal insulation characteristics.

SUMMARY OF THE INVENTION

An objective of the present disclosure is to provide a testing device for study of a magnetized plasma artillery gunpowder, which can make an in-depth analysis of effects of gas temperature on plasma thermal insulation characteristics, effects of plasma density on the plasma thermal insulation characteristics, and effects of magnetic field intensity and magnetic field direction on the plasma thermal insulation characteristics, and can provide design parameters in aspects for designing and manufacturing more advanced magnetized plasma artilleries.

The testing device for study of a magnetized plasma artillery and gunpowder according to the present disclosure includes a pedestal, wherein a top end of the pedestal is provided with a sliding slot for mounting a buffer device, which penetrates through an upper part of the pedestal along a front-rear direction. The sliding slot for mounting the buffer device is internally provided with a buffering slider, which can slide back and forth along the sliding slot for mounting the buffer device. A top end of the buffering slider is provided with a gunpowder combustion chamber fixing groove, which penetrates through an upper part of the buffering slider along the front-rear direction. The gunpowder combustion chamber fixing groove is internally provided with a gunpowder combustion chamber, an upper part of the gunpowder combustion chamber is provided with a positioning ferrule for fixing the gunpowder combustion chamber, wherein a left end of the positioning ferrule is fixedly connected to a left side of the top end of the buffering slider, and a right end of the positioning ferrule is fixedly connected to a right side of the top end of the buffering slider.

A front end of the gunpowder combustion chamber is provided with an exhaust port. The exhaust port of the gunpowder combustion chamber communicates with an air inlet at a back end of an artillery simulated tube. The back end of the artillery simulated tube is fixedly connected to the front end of the gunpowder combustion chamber. Nearby an outer lateral wall of the artillery simulated tube there is provided at least one permanent magnet or electromagnetic coil, wherein the permanent magnet or the electromagnetic coil may generate a magnetic field in the artillery simulated tube.

A side wall of the artillery simulated tube is provided with at least one temperature sensor used for measuring internal temperature of the artillery simulated tube, at least one pressure sensor used for measuring internal pressure of the artillery simulated tube, and at least one magnetic field sensor used for measuring internal magnetic field intensity of the artillery simulated tube.

A side wall of the gunpowder combustion chamber is provided with at least one pressure sensor used for measuring internal pressure of the gunpowder combustion chamber and at least one visible window used for measuring internal spectrum of the gunpowder combustion chamber, wherein the visible window is provided with a plugging block made of sapphire.

In the testing device for study of a magnetized plasma artillery and gunpowder according to the present disclosure, the pedestal is fixedly mounted on a baseplate, and on the artillery simulated tube there are sequentially provided 2-6 temperature sensors from front to back, 2-6 pressure sensors from front to back, and 2-6 magnetic field sensors from front to back.

In the testing device for study of a magnetized plasma artillery and gunpowder according to the present disclosure, the artillery simulated tube is provided with a gas flow rate sensor used for measuring gas flow rate inside the artillery simulated tube.

In the testing device for study of a magnetized plasma artillery and gunpowder according to the present disclosure, the artillery simulated tube is made from carbon fiber, and the back end of the artillery simulated tube is fixedly connected to the front end of the gunpowder combustion chamber through a screw thread.

In the testing device for study of a magnetized plasma artillery and gunpowder according to the present disclosure, the electromagnetic coil is mounted on the baseplate while the location of the electromagnetic coil is adjustable along a front-rear direction.

When the testing device for study of a magnetized plasma artillery and gunpowder according to the present disclosure is used, propellant powder and a simulated warhead may be placed in the gunpowder combustion chamber and ignited, such that the detonated propellant powder pushes the simulated warhead to be ejected through the artillery simulated tube, blasting gas passing through the artillery simulated tube in the axial direction is in a plasma state. The blasting gas in the plasma state may move along the artillery simulated tube to the magnetic field generated by the permanent magnet or the electromagnetic coil in the artillery simulated tube, and may be subjected to the magnetic field. The artillery simulated tube is provided with at least one temperature sensor used for measuring internal temperature of the artillery simulated tube, at least one pressure sensor used for measuring internal pressure of the artillery simulated tube, and at least one magnetic field sensor used for measuring internal magnetic field intensity of the artillery simulated tube. Therefore, the value of the internal temperature of the artillery simulated tube may be measured by the temperature sensor, the value of the internal pressure of the artillery simulated tube may be measured by the pressure sensor, and the value of the internal magnetic field intensity of the artillery simulated tube can be measured by the magnetic field sensor. Next, analysis and research of mechanisms of the magnetized plasma artillery can be made based on variations of the value of the internal temperature, the value of the internal pressure and the value of the internal magnetic field intensity of the artillery simulated tube. Therefore, the testing device for study of a magnetized plasma artillery and gunpowder according to the present disclosure can make an in-depth analysis of effects of gas temperature on plasma thermal insulation characteristics, effects of plasma density on the plasma thermal insulation characteristics, and effects of magnetic field intensity and magnetic field direction on the plasma thermal insulation characteristics, and can provide design parameters in aspects for designing and manufacturing more sophisticated magnetized plasma artilleries.

The testing device for study of a magnetized plasma artillery and gunpowder according to the present disclosure will be further described below with reference to the accompanying drawings.

DETAILED DESCRIPTION OF THE EMBODIMENTS

Figure 1:
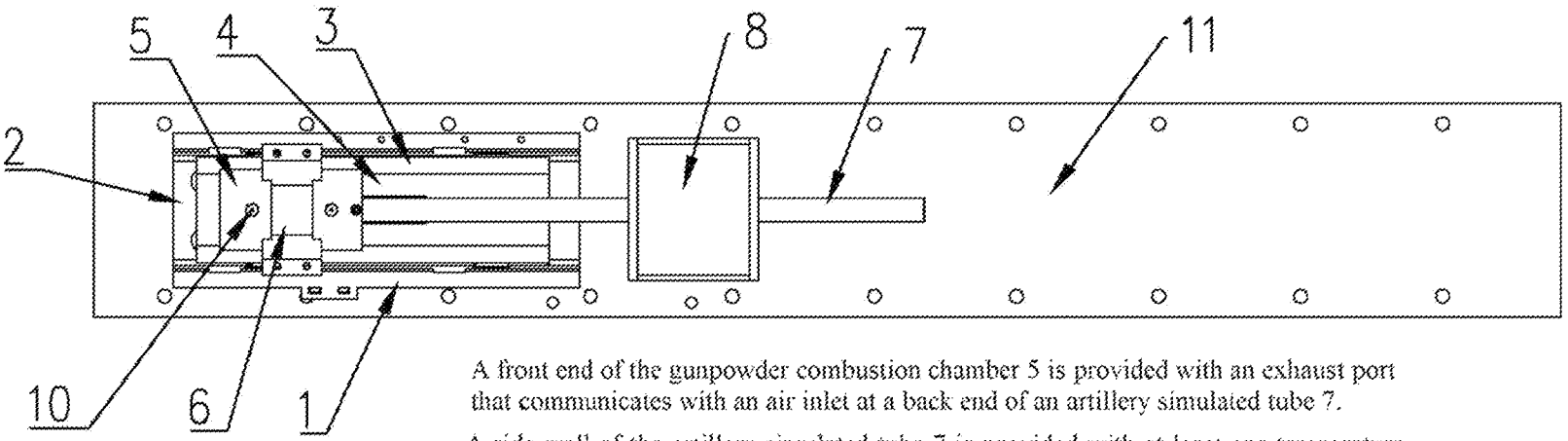
FIG. 1 is a principal view of a testing device for study of a magnetized plasma artillery and gunpowder according to the present disclosure.
Figure 2:
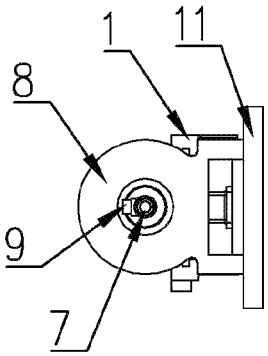
FIG. 2 is a right side view of FIG. 1.
Figure 3:
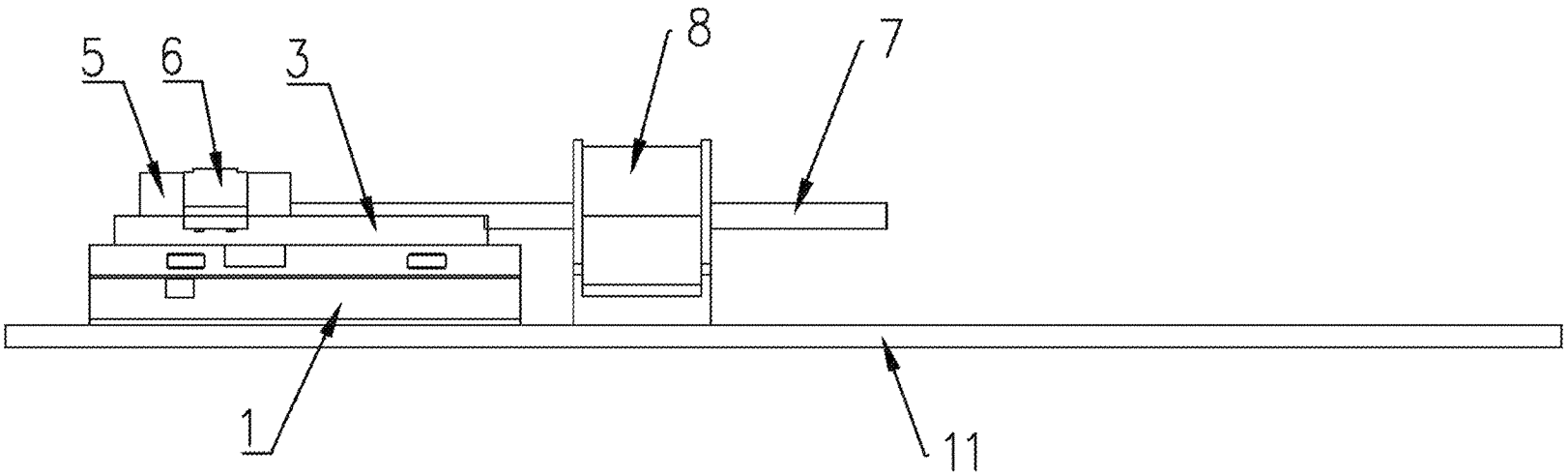
FIG. 3 is a vertical view of FIG. 1.
Figure 4:
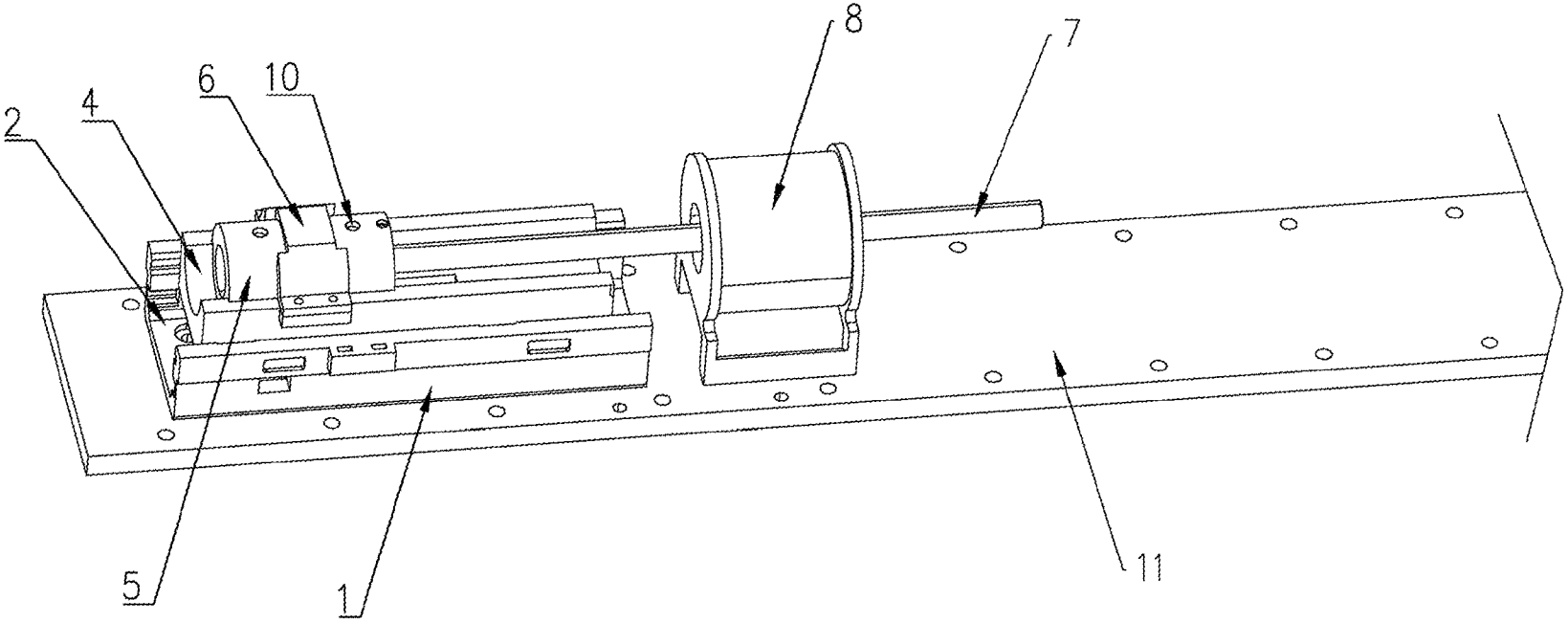
FIG. 4 is a pictorial drawing of a testing device for study of a magnetized plasma artillery and gunpowder according to the present disclosure.

As shown in FIG. 1, FIG. 2, FIG. 3 and FIG. 4, the testing device for study of a magnetized plasma artillery and gunpowder according to the present disclosure includes a pedestal 1. A top end of the pedestal 1 is provided with a sliding slot 2 for mounting a buffer device, which penetrates through an upper part of the pedestal 1 along a front-rear direction. The sliding slot 2 for mounting the buffer device is internally provided with a buffering slider 3, which can slide back and forth along the sliding slot 2 for mounting the buffer device. A top end of the buffering slider 3 is provided with a gunpowder combustion chamber fixing groove 4, which penetrates through an upper part of the buffering slider 3 along the front-rear direction. The gunpowder combustion chamber fixing groove 4 is internally provided with a gunpowder combustion chamber 5, an upper part of the gunpowder combustion chamber 5 is provided with a positioning ferrule 6 for fixing the gunpowder combustion chamber 5, wherein a left end of the positioning ferrule 6 is fixedly connected to a left side of the top end of the buffering slider 3, and a right end of the positioning ferrule 6 is fixedly connected to a right side of the top end of the buffering slider 3.

A front end of the gunpowder combustion chamber 5 is provided with an exhaust port. The exhaust port of the gunpowder combustion chamber 5 communicates with an air inlet at a back end of an artillery simulated tube 7. The back end of the artillery simulated tube 7 is fixedly connected to the front end of the gunpowder combustion chamber 5. Nearby an outer lateral wall of the artillery simulated tube 7 there is provided at least one permanent magnet or electromagnetic coil 8, wherein the permanent magnet or the electromagnetic coil 8 generates a magnetic field in the artillery simulated tube 7.

A side wall of the artillery simulated tube 7 is provided with at least one temperature sensor (not shown in the figure) used for measuring internal temperature of the artillery simulated tube 7, at least one pressure sensor 9 used for measuring internal pressure of the artillery simulated tube 7, and at least one magnetic field sensor (not shown in the figure) used for measuring internal magnetic field intensity of the artillery simulated tube 7.

A side wall of the gunpowder combustion chamber 5 is provided with at least one pressure sensor used for measuring internal pressure of the gunpowder combustion chamber 5 and at least one visible window 10 used for measuring internal spectrum of the gunpowder combustion chamber 5, wherein the visible window 10 is provided with a plugging block made of sapphire.

As further improvement of the present disclosure, the pedestal 1 is fixedly mounted on a baseplate 11, and on the artillery simulated tube 7 there are sequentially provided 2-6 temperature sensors from front to back, 2-6 pressure sensors 9 from front to back, and 2-6 magnetic field sensors from front to back. When in use, a plurality of values of internal temperature of the artillery simulated tube 7 can be synchronously measured by the 2-6 temperature sensors, a plurality of values of internal pressure of the artillery simulated tube 7 can be synchronously measured by the 2-6 pressure sensors 9, and a plurality of values of internal magnetic field intensity of the artillery simulated tube 7 can be synchronously measured by the 2-6 magnetic field sensors.

As further improvement of the present disclosure, the artillery simulated tube 7 is provided with a gas flow rate sensor used for measuring gas flow rate inside the artillery simulated tube 7.

As further improvement of the present disclosure, the artillery simulated tube 7 is made from carbon fiber, and the back end of the artillery simulated tube 7 is fixedly connected to the front end of the gunpowder combustion chamber 5 through a screw thread.

As further improvement of the present disclosure, the electromagnetic coil 8 is mounted on the baseplate 11 while the location of the electromagnetic coil is adjustable along a front-rear direction. When in use, the electromagnetic coil 8 can form magnetic field in different parts in the artillery simulated tube 7 by adjusting the location of the electromagnetic coil 8.

When the testing device for study of a magnetized plasma artillery and gunpowder according to the present disclosure is used, propellant powder and a simulated warhead is placed in the gunpowder combustion chamber 5 and ignited, such that the detonated propellant powder pushes the simulated warhead to be ejected through the artillery simulated tube 7, blasting gas passing through the artillery simulated tube 7 in the axial direction is in a plasma state. The blasting gas in the plasma state may move along the artillery simulated tube 7 to the magnetic field generated by the permanent magnet or the electromagnetic coil 8 in the artillery simulated tube 7, and may be subjected to the magnetic field. The artillery simulated tube 7 is provided with at least one temperature sensor used for measuring internal temperature of the artillery simulated tube 7, at least one pressure sensor 9 used for measuring internal pressure of the artillery simulated tube 7, and at least one magnetic field sensor used for measuring internal magnetic field intensity of the artillery simulated tube 7. Therefore, the value of the internal temperature of the artillery simulated tube 7 can be measured by the temperature sensor, the value of the internal pressure of the artillery simulated tube 7 can be measured by the pressure sensor 9, and the value of the internal magnetic field intensity of the artillery simulated tube 7 can be measured by the magnetic field sensor. Next, analysis and research of mechanisms of the magnetized plasma artillery may be made based on variations of the value of the internal temperature, the value of the internal pressure and the value of the internal magnetic field intensity of the artillery simulated tube 7. Therefore, the testing device for study of a magnetized plasma artillery and gunpowder according to the present disclosure can make an in-depth analysis of effects of gas temperature on plasma thermal insulation characteristics, effects of plasma density on the plasma thermal insulation characteristics, and effects of magnetic field intensity and magnetic field direction on the plasma thermal insulation characteristics, and can provide design parameters in various aspects for designing and manufacturing more sophisticated magnetized plasma artilleries.

The testing device for study of a magnetized plasma artillery and gunpowder according to the present disclosure can be used for making a study of effects of gas flow rate on plasma thermal insulation characteristics, effects of gas temperature on the plasma thermal insulation characteristics, effects of plasma density on the plasma thermal insulation characteristics, and effects of magnetic field intensity and magnetic field direction on the plasma thermal insulation characteristics, and can provide design parameters in aspects for designing and manufacturing more advanced magnetized plasma artilleries.

What is claimed is:

1. A testing device for study of a magnetized plasma artillery and gunpowder, comprising a pedestal, wherein a top end of the pedestal is provided with a sliding slot for mounting a buffer device, the sliding slot for mounting the buffer device penetrates through an upper part of the pedestal along a front-rear direction, the sliding slot for mounting the buffer device is internally provided with a buffering slider, the buffering slider slides back and forth along the sliding slot for mounting the buffer device, a top end of the buffering slider is provided with a gunpowder combustion chamber fixing groove, the gunpowder combustion chamber fixing groove penetrates through an upper part of the buffering slider along the front-rear direction, the gunpowder combustion chamber fixing groove is internally provided with a gunpowder combustion chamber, an upper part of the gunpowder combustion chamber is provided with a positioning ferrule for fixing the gunpowder combustion chamber, a left end of the positioning ferrule is fixedly connected to a left side of the top end of the buffering slider, and a right end of the positioning ferrule is fixedly connected to a right side of the top end of the buffering slider;

a front end of the gunpowder combustion chamber is provided with an exhaust port, the exhaust port of the gunpowder combustion chamber communicates with an air inlet at a back end of an artillery simulated tube, the back end of the artillery simulated tube is fixedly connected to the front end of the gunpowder combustion chamber, nearby an outer lateral wall of the artillery simulated tube there is provided at least one permanent magnet or electromagnetic coil, and the permanent magnet or the electromagnetic coil generates a magnetic field in the artillery simulated tube;

a side wall of the artillery simulated tube is provided with at least one temperature sensor used for measuring internal temperature of the artillery simulated tube, at least one pressure sensor used for measuring internal pressure of the artillery simulated tube, and at least one magnetic field sensor used for measuring internal magnetic field intensity of the artillery simulated tube; and a side wall of the gunpowder combustion chamber is provided with at least one pressure sensor used for measuring internal pressure of the gunpowder combustion chamber and at least one visible window used for measuring internal spectrum of the gunpowder combustion chamber, and the visible window is provided with a plugging block made of sapphire.

2. The testing device for study of a magnetized plasma artillery and gunpowder according to claim 1, wherein the pedestal is fixedly mounted on a baseplate, on the artillery simulated tube there are sequentially provided 2-6 temperature sensors from front to back, 2-6 pressure sensors from front to back, and 2-6 magnetic field sensors from front to back.

3. The testing device for study of a magnetized plasma artillery and gunpowder according to claim 2, wherein the artillery simulated tube is provided with a gas flow rate sensor used for measuring gas flow rate inside the artillery simulated tube.

4. The testing device for study of a magnetized plasma artillery and gunpowder according to claim 1, wherein the artillery simulated tube is made from carbon fiber, and the back end of the artillery simulated tube is fixedly connected to the front end of the gunpowder combustion chamber through a screw thread.

5. The testing device for study of a magnetized plasma artillery and gunpowder according to claim 4, wherein the electromagnetic coil is mounted on the baseplate while the location of the electromagnetic coil is adjustable along a front-rear direction.

6. The testing device for study of a magnetized plasma artillery and gunpowder according to claim 2, wherein the artillery simulated tube is made from carbon fiber, and the back end of the artillery simulated tube is fixedly connected to the front end of the gunpowder combustion chamber through a screw thread.

7. The testing device for study of a magnetized plasma artillery and gunpowder according to claim 6, wherein the electromagnetic coil is mounted on the baseplate while the location of the electromagnetic coil is adjustable along a front-rear direction.

8. The testing device for study of a magnetized plasma artillery and gunpowder according to claim 3, wherein the artillery simulated tube is made from carbon fiber, and the back end of the artillery simulated tube is fixedly connected to the front end of the gunpowder combustion chamber through a screw thread.

9. The testing device for study of a magnetized plasma artillery and gunpowder according to claim 8, wherein the electromagnetic coil is mounted on the baseplate while the location of the electromagnetic coil is adjustable along a front-rear direction.

* * * * *